US005675213A

United States Patent [19]

Huang et al.

[11] Patent Number: 5,675,213

[45] Date of Patent: Oct. 7, 1997

[54] CATHODE RAY TUBE DEFLECTION YOKE WITH REDUCED ELECTRIC FIELD RADIATION FROM TERMINAL PINS OF PRINTED CIRCUIT BOARD ON YOKE

[75] Inventors: Chi-Fang Huang, Taipei; Ping-Hung Kuo, Hsi-Kang Hsiang, both of Taiwan

[73] Assignee: Chunghwa Picture Tubes, Ltd, Taiwan

[21] Appl. No.: 558,704

[22] Filed: Nov. 16, 1995

[51] Int. Cl.[6] ..... H01J 29/70

[52] U.S. Cl. ..... 313/440; 335/214; 335/301

[58] Field of Search ..... 313/154, 239, 313/313, 326, 334, 440, 402, 479; 324/200, 201, 202, 225; 361/790, 791; 335/301, 304, 214

[56] References Cited

U.S. PATENT DOCUMENTS

| | | | |
|---|---|---|---|
| 4,709,220 | 11/1987 | Sakane et al. | 335/214 |
| 5,049,847 | 9/1991 | Okuyama et al. | 315/214 |
| 5,189,348 | 2/1993 | Yokota et al. | 315/399 |
| 5,191,307 | 3/1993 | Mashimoto et al. | 315/214 |
| 5,220,241 | 6/1993 | Kanazawa et al. | 313/440 |
| 5,414,345 | 5/1995 | Rogers | 324/72 |
| 5,552,715 | 9/1996 | Rogers | 324/72 |

*Primary Examiner*—Sandra L. O'Shea
*Assistant Examiner*—Jay M. Patidar
*Attorney, Agent, or Firm*—Donald S. Cohen

[57] ABSTRACT

The present invention is directed to a cathode ray tube having a neck portion and a funnel portion at one end of the neck portion. A yoke extends around the neck portion and has a printed circuit board mounted thereon. The printed circuit board includes a plurality of pins mounted on and projecting in the same direction from the board and a plurality of electrical components mounted on the board and electrically connected in a desired circuit and to the pins. The pins are shortened so as to be of a length that at the operating frequencies of the yoke they do not emit a substantial amount of electromagnetic radiation.

6 Claims, 2 Drawing Sheets

CATHODE RAY TUBE DEFLECTION YOKE WITH REDUCED ELECTRIC FIELD RADIATION FROM TERMINAL PINS OF PRINTED CIRCUIT BOARD ON YOKE

FIELD OF THE INVENTION

The present invention is directed to a cathode ray tube deflection yoke with reduced electric field radiation, and, more particularly, to reducing the electric field radiation from a circuit board mounted on the yoke.

BACKGROUND OF THE INVENTION

A cathode ray tube (CRT), in general, comprise a glass bulb having a tubular neck section at one end, and a funnel section at the other end. The funnel section has a large face plate on which are layers of phosphor to form a screen on which a picture is formed. In the neck is an electron gun which generates at least one electron beam and directs the beam onto the screen on the face plate. For a color CRT the gun generates three electron beams and directs the beams onto the face plate. Around the neck adjacent the funnel section is a yoke which is formed of a plurality of electrical windings. An electrical current is applied to the windings of the yoke which generates a magnetic field. The magnetic field is applied to the electron beams so as to deflect the beams across the screen on the face plate. As shown in U.S. Pat. No. 4,709,220 (Sakane et al.) issued Nov. 24, 1987, and entitled "Radiation Suppression Device", a printed circuit board is often mounted on the yoke. The printed circuit board has electrical components, for example, resistors, capacitors and inductors etc., thereon which form a circuit system which serve to perform many corrections or compensations for the diverse error caused by the deflection yoke, for example, coma error, astigmatism error and green droop, etc.

One problem with the CRT yoke is that it often emits unwanted electric and magnetic fields which are through to be dangerous to the human body. The following Table I shows a typical set of measured emitted electrical field strengths around a cathode-ray-tube on which a deflection yoke is operated. Data under different operating frequencies are also compared in this table.

TABLE I

| | Measured Electrical Field Strength (V/m) | | |
|---|---|---|---|
| Positions | 31 kHz | 38 kHz | 48 kHz |
| 0 Degree | 1.971 | 2.08 | 2.40 |
| 90 Degree | 1.500 | 1.521 | 1.756 |
| 180 Degree | 1.230 | 1.275 | 1.511 |
| 210 Degree | 2.25 | 2.38 | 2.80* |

Many countries have set safety regulations to limit the emission of radiation from the CRT. There are two frequency bands which are most often considered, i.e., extremely low frequency (ELF) which is between 5 and 2000 Hz, and very low frequency (VLF) which is between 2 k and 400 kHz. One safety regulation sets the electric field limits for these two bands at <25V/m for ELF and <2.5V/m for VLF, and another safety regulation sets the electrical field limits for these two bands at 10V/m for ELF and 1.0V/m for VLF. The value 2.80V/m with asterisk in the Table I indicates that the data is out of limitation. Much of the unwanted radiation results from a leaking magnetic field generated by a deflection coil through which the horizontal deflection current flows, a flyback transformer, a horizontal separation control coil and a horizontal linearity control coil. Much of the unwanted radiation is suppressed by inserting auxiliary coils in the yoke which cancel the leaking electromagnetic field. However, it has been found that there is still some undesirable electromagnetic field being radiated from other parts of the yoke, such as the printed circuit board on which there may be several components, such as a horizontal differential coil, chocks or conductors, etc., many of which are capable of generating electromagnetic field into the air. Therefore it is desirable to be able to further suppress leakage of radiation from the yoke.

SUMMARY OF THE INVENTION

The present invention is directed to a cathode ray tube which has a neck section, a funnel section, a yoke extending around the neck, and a printed circuit board on the yoke. The printed circuit board comprises a board, a plurality of pins extending through the board and extending therefrom, and electrical components connected to the pins. The pins are of a length that they do not emit a substantial amount of electromagnetic radiation at the operating frequencies of the yoke.

DETAILED DESCRIPTION

Figure 1:
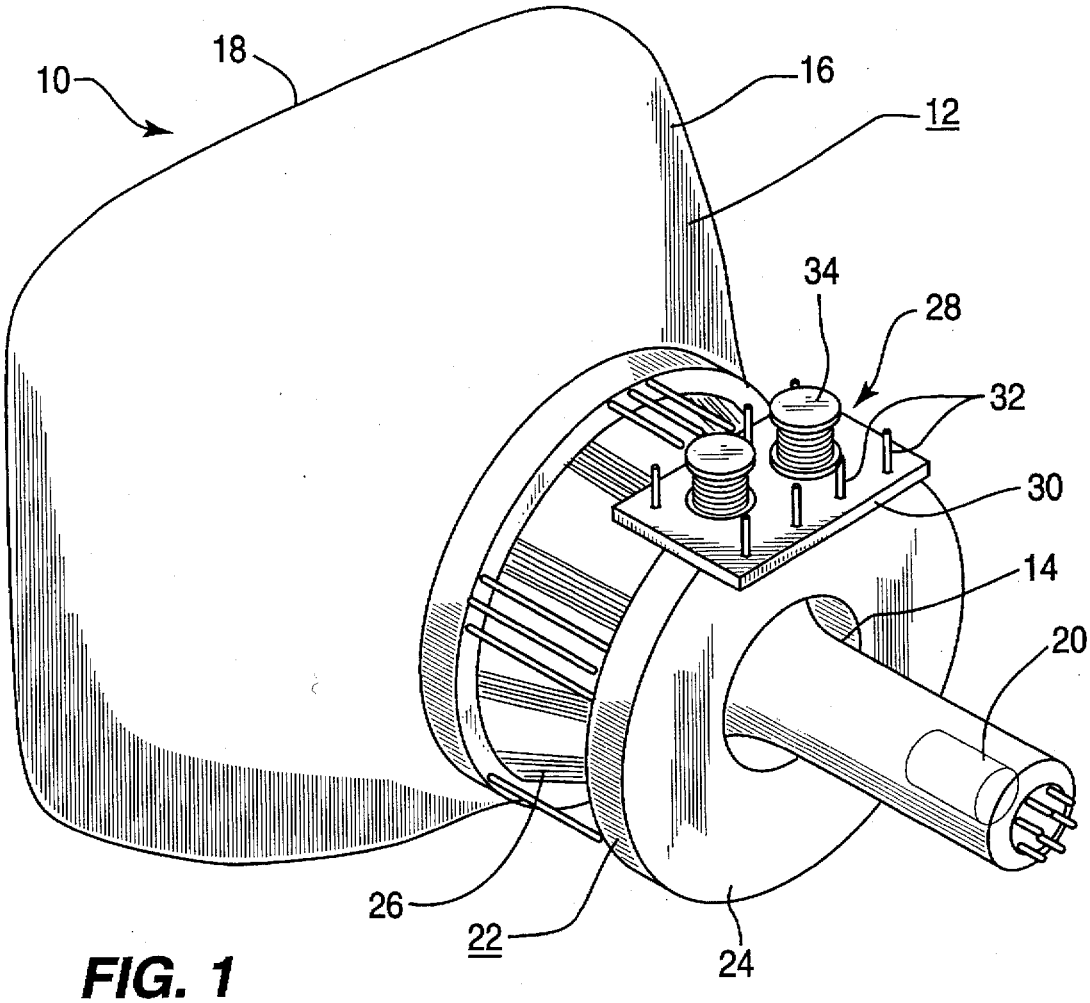
FIG. 1 is a perspective view of a cathode ray tube have a yoke and printed circuit board thereon.

Referring to FIG. 1 of the drawing, a cathode ray tube (CRT) is generally designated as 10. CRT 10 comprises a glass bulb 12 having at one end a tubular neck section 14, and at its other end a funnel section 16. The funnel section 16 has a face plate 18 extending across its larger end. Layer of phosphors (not shown) are coated on the inner surface of the face plate 18 to form a picture screen. In the rear end of the neck section 14 is a gun 20 which is adapted to generate at least one beam of electrons and direct the beam onto the screen on the inner surface of the face plate 18. For a color CRT, the gun is adapted to generate three beams of electrons which are directed along parallel paths to the face plate 18. Around a portion of the neck section 14 and an adjacent portion of the funnel section 16 is a yoke 22. As is well known in the art, the yoke is formed of a support 24 having a plurality of wire coils 26 extending therearound. Current passing through the coils 26 of the yoke 22 cause the beams to be deflected across the screen on the face plate 18 to form a picture.

Figure 2:
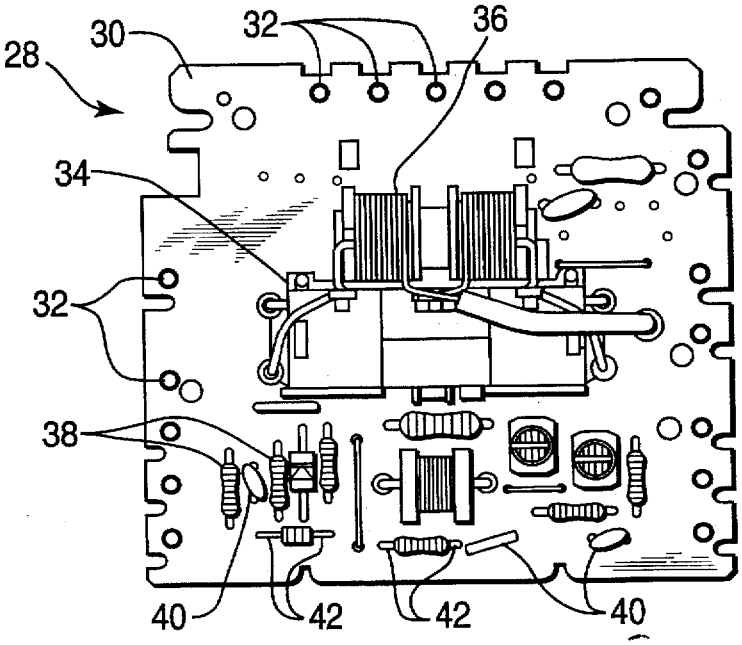
FIG. 2 is a top plane view of a typical printed circuit board for the yoke of a cathode ray tube.

Mounted on the yoke support 24 and extending across the coils 26 is a printed circuit board 28. The printed circuit board 28 comprises a flat board 30 of an insulating material having a plurality of metal pins 32 extending through and projecting upwardly from the top surface of the board 30. The pins 32 are in spaced relation along at least one edge of the board 30. A plurality of electrical components 34 are mounted on the top surface of the board. In FIG. 1, the printed circuit board 28 is shown as having only a few electrical components 34 thereon. However, FIG. 2 shows a more typical printed circuit board 28 having a plurality of different components 34 thereon which can include differential coils 36, resistors 38, capacitors 40 and the like. The components 34 have terminals 42 which extend through the board 30. On the back surface of the board 30 are lines of a conductive material (not shown) which electrically connect the terminals 42 of the electrical components 34 and the pins 32 to form a desired electrical circuit. The pins 32 also serve to provide for electrical connection to both the chassis (not shown) of the television set or monitor, and the coils 26 of the yoke 22 by means of wires (not shown) which are connected to the pins 32.

Figure 4:
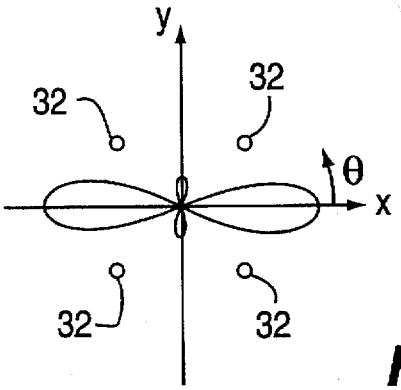
FIG. 4 is a diagram showing the possible radiation pattern from an array of pins on a printed circuit board.

We have found that the pins 32, which are generally about 1 cm or longer in height, when the circuit is operating at a frequency as high as about 64 kHz, act as a group of radiating monopole antenna causing undesired electromagnetic emission. Because of the arrangement of the pins 32 on the board 30, they act as an antenna array, resulting in a radiation effect which is more evident. By making a cluster of a couple of antenna elements (the pins 32), the antenna array can be employed to rearrange the radiation pattern emitted by the pins 32 such that the transmitting or received weighting electromagnetic field strength may be intensified in some certain directions. For example, as shown in FIG. 4, the pins 32 are arranged in an array which provides a radiation pattern which is stronger in the x-direction than in the y-direction. Other patterns of the pins 32 can provide an array which will provide other types of radiation patterns.

Figure 3:
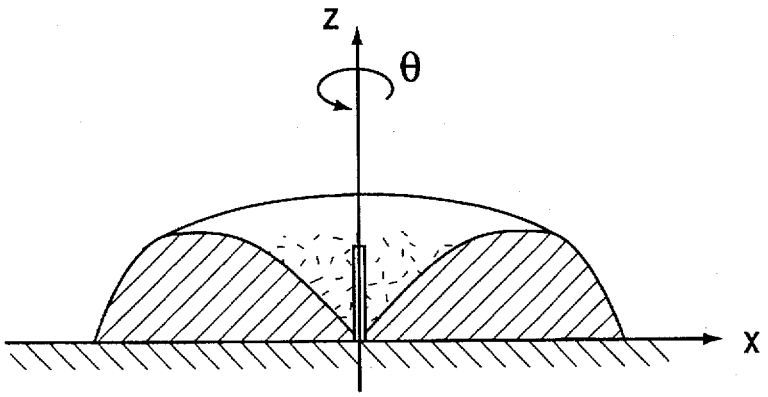
FIG. 3 is a diagram showing 3-dimensional electromagnetic radiation pattern from a pin on a printed circuit board.
Figure 5A:
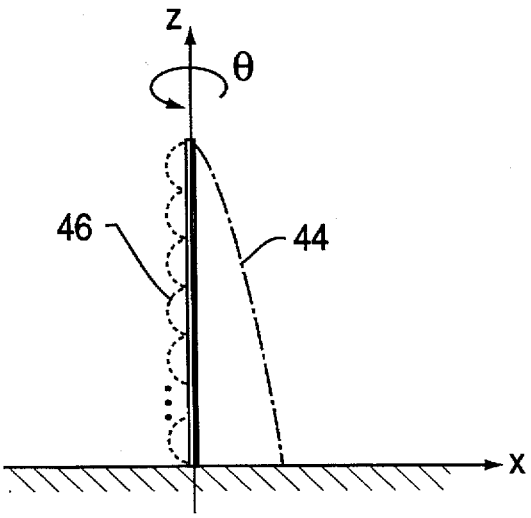
FIGS. 5*a* and 5*b* are diagrams showing the current pattern through a pin of normal length and a pin of the present invention respectively.
Figure 5B:
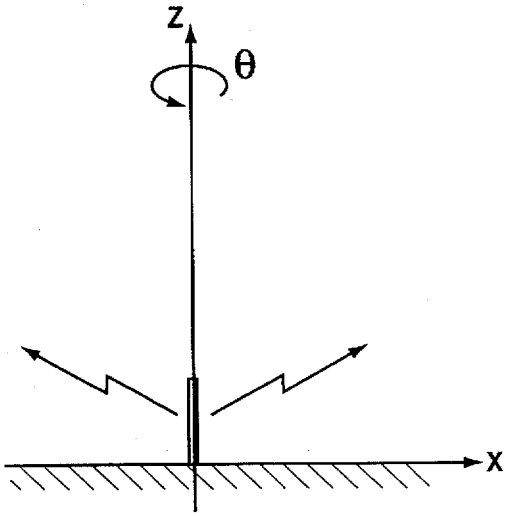

We have also found that the undesired electric field radiation from the pins 32 can be avoided by making the height of the pins 32 less than a 10,000th long of the harmonic free-space wavelength of the 100 time scan frequency. Thus, for an operating frequency of 57 kHz the pins 32 should project from the board 30 a distance of no longer than 5.26 mm and for an operating frequency of 64 kHz the pins should project from the board 30 a distance of no longer than 4.69 mm. By controlling the height of the pins 32 from the board 30, undesired radiation of an electric field from the pins 32 is reduced, if not eliminated, so as to reduce the overall radiation from the yoke 22. FIG. 3 shows the radiation pattern around an antenna, such as a pin 32. As can be seen from this Fig., the strength of the electromagnetic field varies with a null radiation field being along the exact z-direction. The source of electromagnetic radiation from an antenna is the distributing current on it. Considering a quarter-wavelength monopole antenna, such as indicated in FIG. 5*a*, it has a fundamental current distribution, line 44, which has a peak value at the base of the antenna and a zero value at the top of the antenna. However, the current has higher harmonics with many ripples, line 46. These higher harmonics will radiate high frequency electromagnetic waves outwardly. However, the pin 32 of the present invention, shown in FIG. 5*b*, is cut very short such the fundamental current distribution and the most potentially occurring higher harmonic current distribution cannot occur on the pin. Thus, the pin 32 of the present invention emits much less electromagnetic radiation.

Thus, there is provided by the present invention, a printed circuit board for use on the yoke of a CRT in which the length of the terminal pins of the board are controlled so as to reduce or eliminate undesired radiation of an electric field from the pins. This helps to reduce the overall radiation which is emitted from the yoke of the CRT.

What is claimed is:

1. In a cathode ray tube having a neck portion, a funnel portion, a yoke extending around the neck portion and a printed circuit board on the yoke, said printed circuit board comprising:

a board, at least one pin mounted on the board and projecting from a surface thereof, and electrical components on the board and electrically connected to the pin, the pin being of a length such that it does not emit a substantial amount of electromagnetic field radiation at the operating frequencies of the yoke.

2. The cathode ray tube in accordance with claim 1 in which there are a plurality of pins mounted on the board and projecting from the surface thereof with each of the pins being of a length such that it does not emit a substantial amount of electromagnetic field radiation at the operating frequencies of the yoke.

3. The cathode ray tube in accordance with claim 2 in which the pins are of a length that they emit an electromagnetic field radiation of less than 25V/m at a frequency of 5–2,000 Hz and less than 2.5V/m at a frequency of 2 k–400 kHz.

4. The cathode ray tube in accordance with claim 2 in which each of the pins projects from the surface of the board a length of about 5.26 mm for 57 kHz and 4.69 mm for 64 kHz.

5. The cathode ray tube in accordance with claim 2 in which all of the pins project from the same surface of the board.

6. The cathode ray tube in accordance with claim 5 in which the pins are arranged in spaced position along at least one edge of the board.

* * * * *